US006059622A

United States Patent [19]

Pruet et al.

[11] Patent Number: 6,059,622

[45] Date of Patent: May 9, 2000

[54] METHOD AND SYSTEM FOR MANUFACTURING A PHOTOCATHODE

[75] Inventors: James D. Pruet, Garland; David G. Couch, Kaufman, both of Tex.

[73] Assignee: Litton Systems, Inc., Woodland Hills, Calif.

[21] Appl. No.: 09/399,422

[22] Filed: Sep. 20, 1999

[51] Int. Cl.[7] ..... H01J 9/00

[52] U.S. Cl. ..... 445/1; 51/63; 51/391

[58] Field of Search ..... 445/1; 451/391, 451/63

[56] References Cited

U.S. PATENT DOCUMENTS 5,679,065 10/1997 Henderson ..... 451/391

5,904,614 5/1999 King ..... 451/390

5,913,718 7/1999 Shendon ..... 451/63

*Primary Examiner*—Kenneth J. Ramsey

*Attorney, Agent, or Firm*—Baker Botts L.L.P.

[57] ABSTRACT

A system for manufacturing a photocathode includes a housing and a retainer disposed within the housing. The retainer includes a seating area operable to receive a first surface of the photocathode. The retainer is operable to independently translate relative to the housing along an axis. The system also includes a weight enclosed within the retainer. The weight is operable to provide a substantially uniform pressure across a second surface of the photocathode as the housing translates across a polishing pad substantially orthogonal to the axis.

20 Claims, 2 Drawing Sheets

METHOD AND SYSTEM FOR MANUFACTURING A PHOTOCATHODE

TECHNICAL FIELD OF THE INVENTION

This invention relates in general to the field of electro-optics and, more particularly, to a method and system for manufacturing a photocathode.

BACKGROUND OF THE INVENTION

There are numerous methods and systems for detecting radiation. In one type of detector, photocathodes are used in conjunction with microchannel plates (MCPs) to detect low levels of electromagnetic radiation. Photocathodes emit electrons in response to exposure to photons. The electrons can then be accelerated by electrostatic fields toward a microchannel plate. A microchannel plate is typically manufactured from lead glass and has a multitude of channels, each one operable to produce cascades of secondary electrons in response to incident electrons. A receiving device then receives the secondary electrons and sends out a signal responsive to the electrons. Since the number of electrons emitted from the microchannel plate is much larger than the number of incident electrons, the signal produced by the device is stronger than it would have been without the microchannel plate.

One example of the use of a photocathode with a microchannel plate is an image intensifier tube. The image intensifier tube is used in night vision devices to amplify low light levels so that the user can see even in very dark conditions. In the image intensifier tube, a photocathode produces electrons in response to photons from an image. The electrons are then accelerated to the microchannel plate, which produces secondary emission electrons in response. The secondary emission electrons are received at a phosphor screen or, alternatively, a charge coupled device (CCD), thus producing a representation of the original image.

Another example of a device that uses a photocathode with a microchannel plate is a scintillation counter used to detect particles. High-energy particles pass through a scintillating material, thereby generating photons. Depending on the type of material used and the energy of the particles, these photons can be small in number. A photocathode in conjunction with a microchannel plate can be used to amplify the photon signal in similar fashion to an image intensifier tube. The detector can thus be used to detect faint particle signals and to transmit a signal to a device, e.g., a counter, that records the particle's presence.

A photocathode may include one or more layers of material deposited or grown on a surface of the photocathode to provide anti-reflection properties, filtering properties, electron transportability properties, and other suitable properties associated with the photocathode. After the layers have been deposited or grown on the surface of the photocathode, the surface of the photocathode generally requires polishing to reduce the layer to a predetermined thickness to provide the desired photocathode properties. The polishing process generally includes translating the photocathode across a polishing pad and/or polishing compound for a predetermined amount of time. Thus, the amount of material removal from the photocathode is a function of the abrasive characteristics of the polishing pad and/or chemical etching properties of the polishing compound, the amount of pressure applied to the photocathode during polishing, and the amount of time the photocathode is polished.

Various types of retaining fixtures may be used to hold the photocathode during the polishing process. An example retaining fixture may include a retainer having a seating area to hold the photocathode as the photocathode is translated across a polishing pad. A weight may be disposed above the retainer opposite the seating area to apply a downwardly directed force to the photocathode during the polishing process. The retainer and weight may also be placed within an outer housing such that forces applied to the outer housing during the polishing process do not affect the force applied to the photocathode.

However, prior systems and methods for manufacturing a photocathode suffer several disadvantages. For example, chemical properties of the polishing compound may cause degradation or oxidation of various components of the retaining fixture, thereby affecting the interaction between the retainer and the outer housing. As a result of component degradation or oxidation, forces applied to the outer housing during the polishing process may be transferred to the photocathode and affect the amount of material removal from the polishing surface of the photocathode.

For example, the amount of pressure applied to the outer housing from one operator to another may differ and cause varying amounts of material removal from different photocathodes, thereby resulting in inconsistent photocathode properties. Additionally, the location, direction, and amount of pressure applied to the outer housing by the operator during the polishing process may vary, thereby resulting in a nonuniform layer thickness across the polished surface of the photocathode.

SUMMARY OF THE INVENTION

Accordingly, a need has arisen for a better technique having greater flexibility and adaptability for manufacturing a photocathode. In accordance with the present invention, a system and method for manufacturing a photocathode is provided that substantially eliminates or reduces disadvantages and problems associated with previously developed systems and methods.

According to one embodiment of the present invention, a system for manufacturing a photocathode comprises a housing and a retainer disposed within the housing. The retainer comprises a seating area operable to receive the photocathode. The retainer is also operable to independently translate relative to the housing along an axis. The system also includes a weight enclosed within the retainer. The weight is operable to provide a substantially uniform pressure over a polishing surface of the photocathode as the housing translates substantially orthogonal to the axis to polish the polishing surface of the photocathode.

According to another embodiment of the present invention, a method for manufacturing a photocathode having a first surface and a second surface comprises enclosing a weight within a retainer. The retainer comprises a seating area operable to receive the first surface of the photocathode. The method comprises disposing a retainer within a housing. The retainer is operable to independently translate relative to the housing along an axis. The method also comprises positioning the first surface of the photocathode on the seating area of the retainer and positioning the second surface of the photocathode against a polishing surface. The method further includes translating the housing across the polishing surface while allowing independent translation of the retainer within the housing along the axis. The weight is operable to provide a substantially uniform pressure across the second surface of the photocathode while the housing translates across the polishing surface.

The technical advantages of the present invention include providing a system and method for manufacturing a photocathode that provides greater uniformity and consistency of photocathodes. For example, according to one aspect of the present invention, a retainer independently translates within a housing as the housing is translated across a polishing compound. A weight enclosed within the retainer provides a substantially uniform pressure across the polishing surface of the photocathode as the housing translates across the polishing compound, thereby providing a substantially uniform layer thickness on the polished surface of the photocathode. The housing and retainer may be constructed from chemically resistant materials while the weight, which may be constructed from a material subject to oxidation or degradation, is shielded from contact with the polishing compound. Thus, the present invention maintains independent translation of the retainer relative to the housing to ensure that a substantially uniform pressure is applied to the photocathode during the polishing process.

Other technical advantages of the present invention will be readily apparent to one skilled in the art from the following figures, descriptions, and claims.

BRIEF DESCRIPTION OF THE DRAWINGS

For a more complete understanding of the present invention, and the advantages thereof, reference is now made to the following descriptions taken in connection with the accompanying drawings, in which.

DETAILED DESCRIPTION OF THE DRAWINGS

Embodiments of the present invention and the advantages thereof are best understood by referring to the following description and drawings, wherein like numerals are used for like and corresponding parts of the various drawings.

Figures 1, 3:
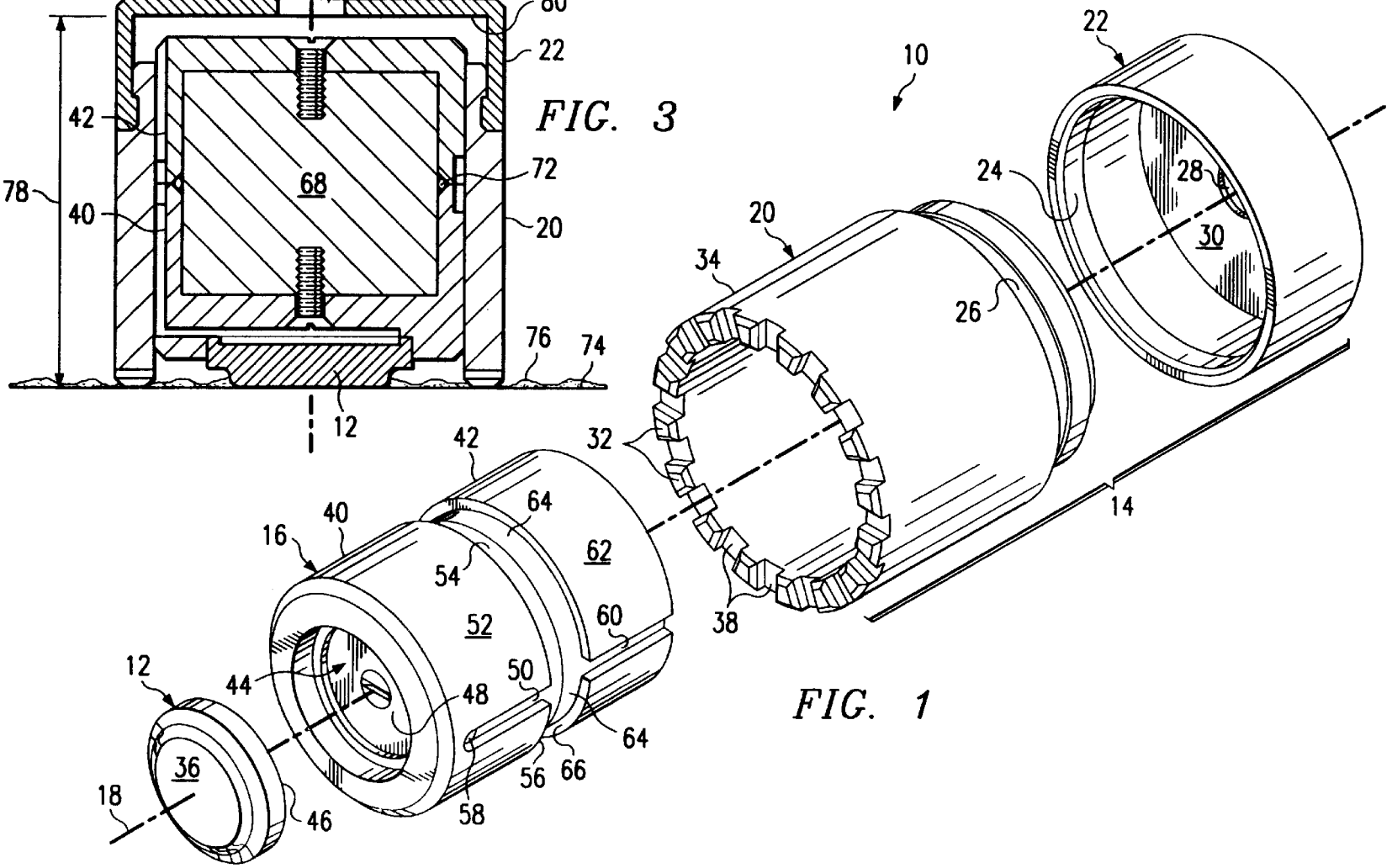
FIG. 1 is an exploded assembly diagram illustrating a system for manufacturing a photocathode in accordance with an embodiment of the present invention.
FIG. 3 is an assembled section view of the system illustrated in FIG. 2.

FIG. 1 is an exploded assembly view of a system 10 for manufacturing a photocathode 12 in accordance with an embodiment of the present invention. System 10 comprises a housing 14 and a retainer 16. Retainer 16 is disposed within housing 14 and translates independently within housing 14 along an axis 18.

Housing 14 comprises a base 20 and a cap 22. Cap 22 comprises a flange 24 to engage a corresponding recess 26 in base 20 to secure cap 22 to base 20. For example, cap 22 may be secured to base 20 using a snap-lock method of attachment; however, other suitable methods may be used to secure cap 22 to base 20. In the embodiment illustrated in FIG. 1, housing 14 is constructed from a plurality of components to facilitate maintenance or replacement of housing 14; however, housing 14 may also be constructed as a single unit.

Cap 22 comprises an opening 28 to relieve a pressure differential between an internal area 30 of housing 14 and an area external to housing 14. For example, opening 28 may be used to relieve a pressure differential resulting from the movement of retainer 16 within housing 14. Base 20 and cap 22 may be constructed from nylon to protect photocathode 12 from scratches and provide chemical resistance to polishing compound material properties. However, base 20 and cap 22 may be constructed using other suitable non-scratching and chemically resistant materials.

Housing 14 also comprises a plurality of spaced apart projections 32 formed on an end 34 of housing. Projections 32 may be used to direct a polishing compound (not explicitly shown) to a polishing surface 36 of photocathode 12 as end 34 of housing 14 is translated across a polishing pad (not explicitly shown). For example, recesses 38 between adjacent projections 32 provide a path for the polishing compound to access the polishing surface 36 of photocathode 12.

Retainer 16 comprises a base 40 and a cover 42. Base 40 comprises a seating area 44 for receiving a seating surface 46 of photocathode 12. Seating area 44 may comprise a recess 48 for receiving seating surface 46 of photocathode 12; however, seating area 44 may comprise other suitable configurations for receiving various photocathode 12 configurations. Base 40 and cover 42 may be constructed from nylon to protect photocathode 12 from scratches and provide chemical resistance to polishing compound material properties. However, base 40 and cover 42 may be constructed using other suitable non-scratching and chemically resistant materials.

Base 40 of retainer 16 comprises a channel 50 extending longitudinally along an exterior surface 52 of base 40 and a channel 54 disposed circumferentially about surface 52 at an end 56 of base 40. Base 40 also comprises a passage 58 extending from channel 50 to seating area 44 of base 40. Cover 42 also comprises a channel 60 extending longitudinally along an exterior surface 62 of cover 42 and a channel 64 extending circumferentially about an end 66 of cover 42. In operation, passage 58 and channels 50, 54, 58, and 64 relieve pressure differentials between internal area 30 of housing 14 and an area external to housing 14. For example, passage 58 and channels 50 and 60 provide a vent path from seating area 44 to internal area 30 of housing 14 to relieve pressure differentials resulting from movement of retainer 16 within housing 14. Additionally, passage 58 and channels 50 and 60 prevent vacuum adhesion of photocathode 12 to seating area 44.

Figure 2:
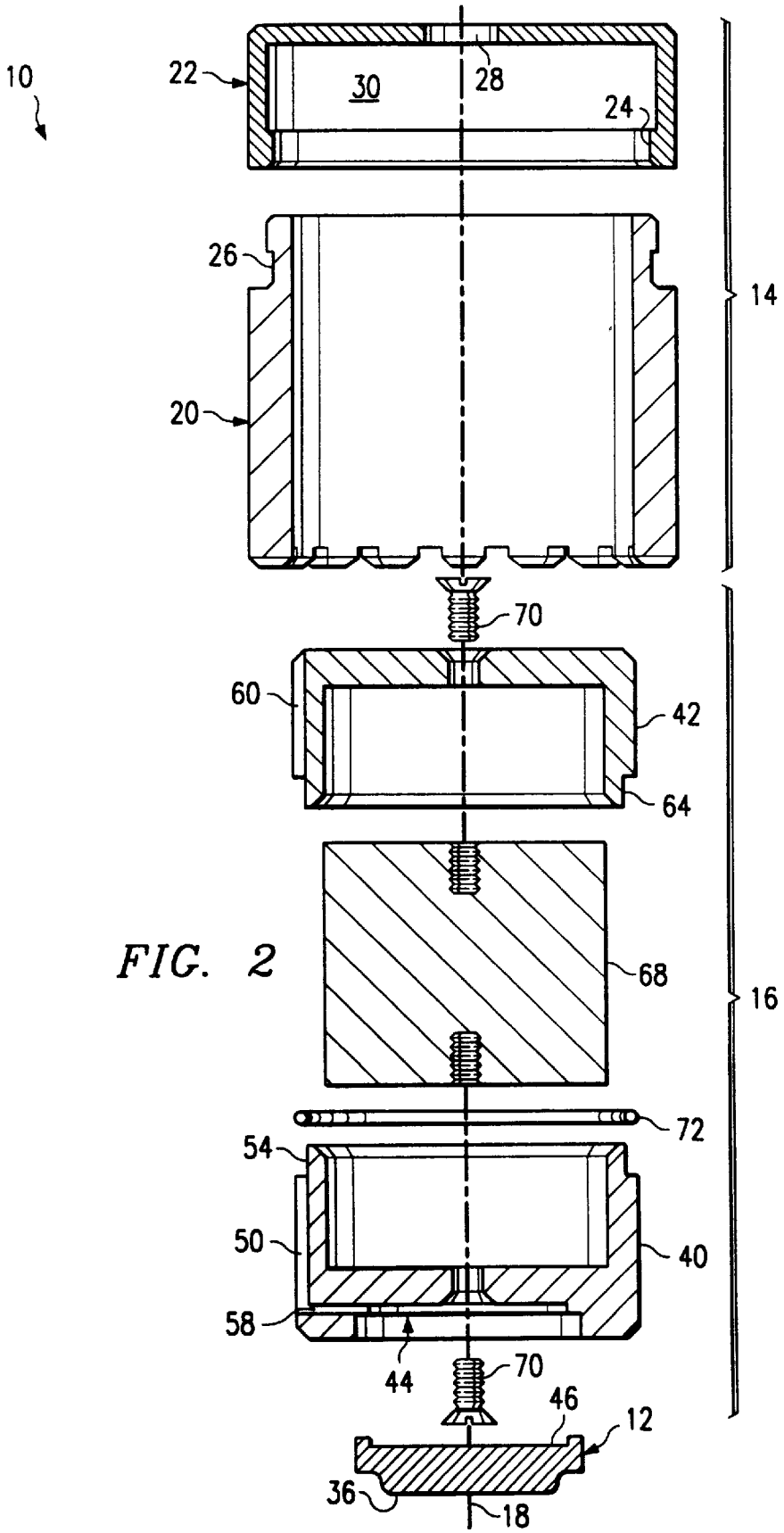
FIG. 2 is an exploded section diagram of the system illustrated in FIG. 1 taken along the line 2—2 of FIG. 1.

Channels 54 and 64 operate to provide a continuous vent path from seating area 44 to internal are 30 of housing 14 to accommodate a variety of positions of base 40 relative to cover 42. For example, base 40 may be secured adjacent cover 42 such that channels 50 and 60 are misaligned. As illustrated in FIG. 2, channel 54 engages channel 64 so that a continuous vent path is provided between channels 50 and 60.

FIG. 2 is an exploded section view of system 10 illustrated in FIG. 1 taken along the line 2—2 of FIG. 1. As illustrated in FIG. 2, system 10 also comprises a weight 68 disposed within retainer 16. Weight 68 may be enclosed within retainer 16 by securing base 40 and cover 42 to weight 68 with screws 70. However, other suitable methods and devices may be used to enclose weight 68 within retainer 16. Screws 70 may be constructed from nylon to provide non-scratching and chemically resistant properties. However, screws 70 may be constructed using other suitable non-scratching and chemically resistant materials.

Weight 68 may be constructed from heavy or dense materials, such as stainless steel, to provide a sufficient downwardly directed force across polishing surface 36 of photocathode 12 to obtain a required amount of material removal from polishing surface 36. However, weight 68 may be constructed using other suitable materials to provide the required downwardly directed force across polishing surface 36 of photocathode 12 during the polishing process.

Weight 68 is enclosed within retainer 16 to maintain independent relational movement between retainer 16 and housing 14. For example, housing 14 and retainer 16 may be constructed from nylon to provide non-scratching and chemical resistance properties. However, the amount of weight required to apply a downward directed force to photocathode 12 during the polishing process to obtain a required amount of material removal may necessitate that weight 68 be constructed from stainless steel. During operation, the polishing compound may cause the degradation or oxidation of weight 68 if the polishing compound contacts weight 68. For example, oxide layers ay form on weight 68. As a result, the oxide layers may inhibit movement of retainer 16 within housing 14, thereby allowing forces applied to housing 14 to be transferred to retainer 16.

Thus, weight 68 may be enclosed within retainer 16 to protect weight 68 from various polishing compounds used during the polishing process and maintain independent relational movement of retainer 16 within housing 14. A seal 72 may also be disposed between base 40 and cover 42 to protect weight 68 from the polishing compound.

FIG. 3 is an assembled section view of system 10 illustrated in FIG. 2 in contact with a polishing pad 74. As illustrated in FIG. 3, photocathode 12 is positioned in seating area 44 of retainer 16, and polishing surface 36 of photocathode 12 is in contact with polishing pad 74 and a polishing compound 76. In operation, housing 14 may be translated across polishing pad 74 to remove a required amount of material from polishing surface 36 of photocathode 12. While housing 14 is translated across polishing pad 74, retainer 16 is allowed to translate independently relative to housing 14 along axis 18 within housing 14. Thus, retainer 16 with weight 68 provides a substantially uniform downwardly directed force across polishing surface 36 of photocathode 12 independent of any downwardly directed forces applied to housing 14. Additionally, projections 32 of housing 14 provide a path for directing polishing compound 76 to polishing surface 36 of photocathode 12.

Housing 14 may be constructed having an interior length 78 to prevent retainer 16 from contacting or "bottoming-out" on an interior surface 80 of housing 14 during the polishing process, thereby maintaining independent relational movement between retainer 16 and housing 14.

As illustrated in FIG. 3, polishing compound 76 is directed between projections 32 to photocathode 12. As a result, polishing compound may also migrate upwardly between retainer 16 and housing 14. Enclosing weight 68 within retainer 16 prevents chemical properties of polishing compound 76 from reacting with chemical properties of weight 68, which may inhibit independent relational movement between retainer 16 and housing 14.

System 10 also provides greater reliability and adaptability than prior system. For example, retainer 16 and housing 14 may be easily disassembled for replacement or maintenance. Additionally, weight 68 may be easily interchanged to provide varying amounts of material removal from photocathode 12 during a polishing process to obtain desired photocathode 12 properties.

Although the present invention and its advantages have been described in detail, it should be understood that various changes, substitutions and alterations can be made without departing from the spirit and scope of the present invention as defined by the appended claims.

What is claimed is:

1. A holder for manufacturing a photocathode comprising:

a housing;

a retainer disposed within the housing, the retainer comprising a seating area operable to receive a first surface of the photocathode, the retainer operable to independently translate relative to the housing along an axis; and a weight enclosed within the retainer, the weight operable to provide a substantially uniform pressure across a second surface of the photocathode as the housing translates across a polishing pad substantially orthogonal to the axis.

2. The holder of claim 1, wherein the housing comprises an opening operable to equalize a pressure differential between an interior area and an external area of the housing.

3. The holder of claim 1, wherein the retainer comprises:

a first portion comprising the seating area;

a second portion; and a seal disposed between the first and second portions.

4. The holder of claim 1, wherein the retainer comprises a channel disposed along an exterior surface of the retainer, the channel operable to equalize a pressure differential between an interior area and an exterior area of the housing.

5. The holder of claim 1, wherein the housing comprises a first end and a second end, the first end disposed adjacent the photocathode, the first end comprising a plurality of projections operable to direct a polishing compound to the polishing surface of the photocathode.

6. The holder of claim 1, wherein the housing comprises a first portion and a second portion, the first portion comprising a flange operable to engage a corresponding recess formed in the second portion.

7. The holder of claim 1, wherein the retainer comprises:

a first portion comprising a first channel disposed along an exterior surface of the first portion;

a second portion comprising a second channel disposed along an exterior surface of the second portion; and wherein the first portion comprises a third channel operable to engage a corresponding fourth channel formed on the second portion, the third and fourth channels operable to connect the first and second channels to relieve a pressure differential between an interior area and an exterior area of the housing.

8. A method for manufacturing a photocathode, the photocathode having a first surface and a second surface, the method comprising:

enclosing a weight within a retainer, the retainer comprising a seating area operable to receive the first surface of the photocathode;

disposing the retainer within a housing, the retainer operable to independently translate relative to the housing along an axis;

positioning the first surface of the photocathode on the seating area of the retainer;

positioning the second surface of the photocathode against a polishing pad; and translating the housing across the polishing pad while allowing independent translation of the retainer relative to the housing along the axis, wherein the weight is operable to provide a substantially uniform pressure across the second surface of the photocathode while the housing translates across the polishing pad.

9. The method of claim 8, wherein enclosing the weight within the retainer comprises:

disposing the weight within a first portion of the retainer;

positioning a second portion of the retainer adjacent the first portion to enclose the weight within the first and second portions; and securing the first and second portions around the weight.

10. The method of claim 9, further comprising disposing a seal between the first and second portions of the retainer.

11. The method of claim 8, wherein disposing the retainer within the housing comprises translating the retainer along the axis within the housing, the housing comprising an opening to relieve a pressure differential between an interior area and an exterior area of the housing.

12. The method of claim 8, wherein disposing the retainer within the housing comprises translating the retainer along the axis within the housing, the retainer comprising a channel to relieve a pressure differential between an interior area and an exterior area of the housing.

13. The method of claim 8, further comprising engaging a plurality of projections formed on the housing with the polishing pad, the projections operable to direct a polishing compound to the second surface of the photocathode.

14. A system for manufacturing a photocathode comprising:

a housing;

a retainer disposed within the housing, the retainer comprising a seating area operable to receive the photocathode, the retainer operable to independently translate within the housing along an axis;

a weight enclosed within the retainer, the weight sized to remove a predetermined amount of material from the photocathode over a predetermined time as the housing translates across a polishing pad; and wherein the retainer is operable to independently translate along the axis while the housing translates across the polishing pad substantially orthogonal to the axis.

15. The system of claim 14, wherein the housing comprises a first end and a second end, the first end disposed adjacent the photocathode, and wherein the first end comprises a plurality of projections operable to direct a polishing compound to the photocathode.

16. The system of claim 14, wherein the retainer comprises:

a first portion;

a second portion; and a seal disposed between the first and second portions, the seal operable to prevent contact between the weight and a polishing compound.

17. The system of claim 14, wherein the retainer comprises a first end and a second end, the first end comprising the seating area, and wherein the retainer further comprises a channel extending from the seating area to the second end, the channel operable to relieve a pressure differential between the seating area and an interior area of the housing.

18. The system of claim 14, wherein the seating area comprises a recess configured to receive the photocathode.

19. The system of claim 14, wherein the retainer comprises:

a first portion secured to a first end of the weight;

a second portion secured to a second end of the weight; and a seal disposed between the first and second portions.

20. The system of claim 14, wherein the housing comprises a first end and a second end, the first end disposed adjacent the photocathode, and wherein the second end comprises an opening operable to relieve a pressure differential between an interior area and an exterior area of the housing while the retainer translates within the housing.

* * * * *